US006003810A

United States Patent [19]

Roze des Ordons et al.

[11] Patent Number: 6,003,810

[45] Date of Patent: Dec. 21, 1999

[54] HOMING HEAD FOR A FLYING BODY

[75] Inventors: Jacques Roze des Ordons, Savigny-sur-Orge; Jean-Pierre Merle, Orsay, both of France

[73] Assignee: Aerospatiale Societe Nationale Industrielle, Paris, France

[21] Appl. No.: 08/936,779

[22] Filed: Sep. 24, 1997

[30] Foreign Application Priority Data

Sep. 25, 1996 [FR] France ..... 96 11657

[51] Int. Cl.[6] ..... F41G 7/00; G01C 21/02; G02B 7/00

[52] U.S. Cl. ..... 244/3.16; 244/3.13; 250/203.2; 359/503

[58] Field of Search ..... 348/31, 332; 359/503, 359/504, 505; 244/3.11, 3.16, 3.13; 250/203.2; 327/13, 14

[56] References Cited

U.S. PATENT DOCUMENTS

| | | | |
|---|---|---|---|
| 3,736,061 | 5/1973 | Knowlden et al. | 356/141 |
| 3,921,154 | 11/1975 | Barkley | 356/157 |
| 3,970,990 | 7/1976 | Carson | 250/208 |
| 4,131,248 | 12/1978 | Berglund | 244/3.16 |
| 4,143,835 | 3/1979 | Jennings, Jr. et al. | 244/311 |
| 4,174,177 | 11/1979 | Gardner et al. | 244/3.16 |
| 4,274,609 | 6/1981 | Ferrier et al. | 244/3.14 |
| 4,424,943 | 1/1984 | Zwirn et al. | 244/3.11 |
| 4,476,494 | 10/1984 | Tugaye | 244/3.17 |
| 4,537,370 | 8/1985 | Pizzurro | 244/3.16 |
| 4,587,426 | 5/1986 | Munier et al. | 250/338 |
| 4,607,287 | 8/1986 | Endo et al. | 358/213 |
| 4,609,824 | 9/1986 | Munier et al. | 250/578 |
| 4,671,650 | 6/1987 | Hirzel et al. | 356/28 |
| 4,777,651 | 10/1988 | McCann et al. | 382/21 |
| 4,871,251 | 10/1989 | Preikschat et al. | 356/336 |
| 5,142,142 | 8/1992 | Senechalle et al. | 250/227.23 |
| 5,187,476 | 2/1993 | Hamer | 340/906 |
| 5,229,594 | 7/1993 | Vilaire et al. | 250/206.2 |
| 5,279,150 | 1/1994 | Katzer et al. | 73/61.66 |
| 5,280,167 | 1/1994 | Dubois | 250/214 |
| 5,323,987 | 6/1994 | Pinson | 244/3.16 |
| 5,341,142 | 8/1994 | Reis et al. | 342/62 |
| 5,430,290 | 7/1995 | Merle et al. | 250/208.1 |
| 5,665,959 | 9/1997 | Fossum et al. | 250/208.1 |

FOREIGN PATENT DOCUMENTS

| | | | |
|---|---|---|---|
| 0 508 905 | 10/1992 | European Pat. Off. . | |
| 633 457 A1 | 1/1995 | European Pat. Off. | G01J 1/46 |
| 0 770 884 | 5/1997 | European Pat. Off. . | |
| 3338191 | 2/1988 | Germany . | |
| WO 86/07162 | 12/1986 | WIPO | G01S 3/78 |

*Primary Examiner*—Theresa M. Wesson
*Attorney, Agent, or Firm*—Marshall, O'Toole, Gerstein, Murray & Borun

[57] ABSTRACT

The present invention relates to a homing head mounted on a flying body, and intended to guide the flying body towards a target. According to the invention, the homing head includes a target detection system (SD1) comprising a system (SI1) for identifying luminous flashes originating from the target, and a target locating system (SL1), which includes a photosensitive detector (D1) mounted fixedly on the flying body and comprising a matrix of photosensitive sensors, and a means of focussing (6) which projects onto said matrix of the photosensitive detector (D1) the image of the scene situated fore of the flying body.

5 Claims, 5 Drawing Sheets

AV
2
1
5
4
3
EL
SD1,SD2
C
M

SD1
SL1
6
AV
D1
13

14
8
9
10
11
12
AV
SI1

D2
7
AV
16
SI2,SL2
15
SD2

HOMING HEAD FOR A FLYING BODY

BACKGROUND OF THE INVENTION

The present invention relates to a homing head mounted on a flying body, and intended to determine orders for guiding said flying body towards a target.

The present invention applies more precisely to a homing head of the type comprising in particular:

a target detection system;

a source of inertial information; and a central unit for processing information determining said guidance orders.

It is known that, in order to guide a flying body, for example from an aircraft, a helicopter or a land station, towards a target, by means of such a homing head, it is usual to point a laser illuminator, for example a laser designator, which emits luminous flashes corresponding to short luminous pulses time-coded at specified frequency or frequencies, at said target so as to illuminate it. The homing head detects the luminous flashes which are reflected by the target and it determines their direction of reflection which corresponds to the direction of the target, which then makes it possible to calculate the orders for guiding said flying body.

In a known manner, in order to carry out detection and location of a target thus illuminated, the homing head uses a reduced-field sensor which is mounted on a platform for orienting and stabilizing the line of sight of said sensor.

Such a usual solution has a number of drawbacks, in particular:

it is complex to implement;

it is necessary to determine, extremely accurately, the position of said platform relative to a reference frame of the flying body; and it is very expensive to produce.

SUMMARY OF THE INVENTION

The object of the present invention is to remedy these drawbacks. It relates to a reduced-cost homing head making it possible to guide, simply and accurately, a flying body towards a target.

To this end, the homing head of the type alluded to above is noteworthy, according to the invention, in that said-target detection system includes:

a system for identifying luminous flashes originating from the target; and a target locating system, which includes:

a photosensitive detector mounted fixedly on the flying body and comprising a matrix of photosensitive sensors; and a means of focussing which projects onto said matrix of the photosensitive detector the image of the scene situated fore of the flying body.

Thus, by virtue of the use of a photosensitive detector which comprises a matrix of photosensitive sensors specified below, and which thus exhibits a large field capable of covering the whole of the target detection zone and of discriminating optically beween various parts of said detection zone, it is possible to mount said photosensitive detector fixedly on the flying body, thus avoiding the need to devise a platform for orientation and stabilization and consequently making it possible to remedy the aforesaid drawbacks.

In a first advantageous embodiment of the invention, said photosensitive detector is a matrix detector of the type with charge coupled device.

In this case, advantageously, said system for identifying luminous flashes includes a photosensitive diode capable of detecting the luminous flashes originating from said scene situated fore of the flying body and means capable of determining, from among said detected luminous flashes, those originating from the designated target, thus making it possible to obtain a simple, accurate and inexpensive identification system.

Furthermore, advantageously, said target detection system includes a shutter shutting off the field of view of the target locating system, said shutter being controlled in such a way as to free said field of view each time a luminous flash originating from said target is expected, thus avoiding placing said target locating system continually in service and enabling it to be protected against damaging luminous beams when it is not in service.

Moreover, in a second particularly advantageous embodiment of the invention, said system for identifying luminous flashes also comprises said photosensitive detector; and said photosensitive detector includes photosensitive sensors respectively fitted with photosensitive diodes capable of transforming the luminous energy received into an electrical signal.

In this second embodiment, advantageously, each of said photosensitive sensors includes, in addition to said photosensitive diode, a means of processing the electrical signals generated by said photosensitive diode, said means of processing comprising a differentiator electrical circuit which:

on the one hand, strengthens the electrical signals exhibiting a fast rise time and corresponding to a luminous flash received by the photosensitive diode; and on the other hand, attenuates the electrical signals exhibiting slow time variation and corresponding to illuminations which vary only slightly in intensity, of said photosensitive diode.

Moreover, advantageously:

each of said photosensitive sensors includes a means of binarization making it possible to determine a binary state of said photosensitive sensor, as a function of the signal formed by said means of processing electrical signals; and each of said photosensitive sensors includes a means of storage allowing said binary state to be recorded.

Moreover, advantageously, said system for identifying luminous flashes is capable of detecting a characteristic variation in illumination, which is greater than a predefined variation, of at least one of said photo-sensitive sensors.

In a first variant, said system for identifying luminous flashes monitors the electrical current consumed by each of said photosensitive sensors, any increase in said consumed electrical current, which is greater than a predefined increase, indicating a characteristic variation in illumination.

In a second variant, said system for identifying luminous flashes monitors the binary state of said photosensitive sensors, any change of the binary state to a state representative of the detection of a luminous flash indicating a characteristic variation in illumination.

Preferably, in this second variant, said system for identifying luminous flashes includes a first network of shift registers, capable of transmitting the binary state of all the photosensitive sensors of the photosensitive detector.

Moreover, said locating system makes it possible advantageously to locate in the matrix of the photosensitive detector the position of each photosensitive sensor which detects a luminous flash.

Advantageously, said locating system includes a second network of shift registers, making it possible to transmit in series in a predefined order the binary state of all the photosensitive sensors, the order of each photosensitive sensor in the transmission series being representative of its position in the matrix.

Furthermore, so as to accurately specify the location in the case in which luminous flashes are detected by several photosensitive sensors, said locating system advantageously includes a means of calculation making it possible to determine a central position from the located positions of all the photosensitive sensors having detected a luminous flash.

Morever, in an advantageous implementation, said locating system:

- determines the intensity of the signal generated by the means of processing of each of the photosensitive sensors having detected a luminous flash;
- determines the position of each of said photosensitive sensors having detected a luminous flash; and
- calculates, from the intensities and positions thus determined, the corresponding barycenter which represents the sought-after location.

BRIEF DESCRIPTION OF THE DRAWINGS

The figures of the appended drawing will clarify the manner in which the invention may be embodied. In these figures, identical references denote similar elements.

DETAILED DESCRIPTION OF THE PREFERRED EMBODIMENTS

Figure 1:
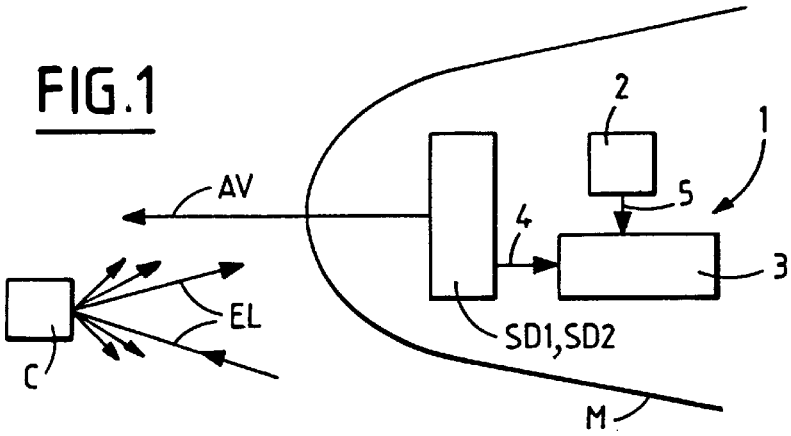
FIG. 1 diagrammatically illustrates a homing head in accordance with the invention and mounted on a flying body.

The homing head 1 in accordance with the invention is mounted on a flying body M, for example a missile, only the fore part of which has been diagrammatically represented in FIG. 1.

In a known manner, said homing head 1, which is intended to determine orders for guiding said flying body M towards a target C, comprises, in particular:

- a target detection system SD1 or SD2;
- a source of inertial information 2; and
- a central unit 3 for processing information and which is linked to said system SD1 or SD2 and to said source 2, respectively by way of links 4 and 5, and which determines said guidance orders.

In a known manner, said target C is illuminated by means of an illuminator (not represented), by luminous flashes EL corresponding to short, coded pulses generally emitted at constant and predefined time intervals, as assumed in the present example.

To be able to carry out the guiding of the flying body M, the target detection system SD1 or SD2 identifies from among all the luminous beams received said luminous flashes EL originating from the target C, i.e. which are reflected by the latter following the illuminating thereof, and it determines the direction thereof.

Of course, in the context of the present invention, in a mode of use and a particular embodiment which is not represented, said target can itself also emit said luminous flashes to indicate to the flying body the direction to be followed in order to reach it.

According to the invention, to locate the target C, said detection system SD1 or SD2 includes:

- a system SI1 or SI2 for identifying luminous flashes EL originating from the target C and emitted at constant and predefined time intervals; and
- a target locating system SL1 or SL2, which includes:
  - a photosensitive detector D1 or D2 mounted fixedly on the flying body M and including a matrix of photosensitive sensors, and
  - a means of focussing 6 or 7 which projects onto said photosensitive detector D1 or D2 the image of the scene situated fore of the flying body M and centered with respect to a sighting axis AV of the homing head 1.

Figure 2:
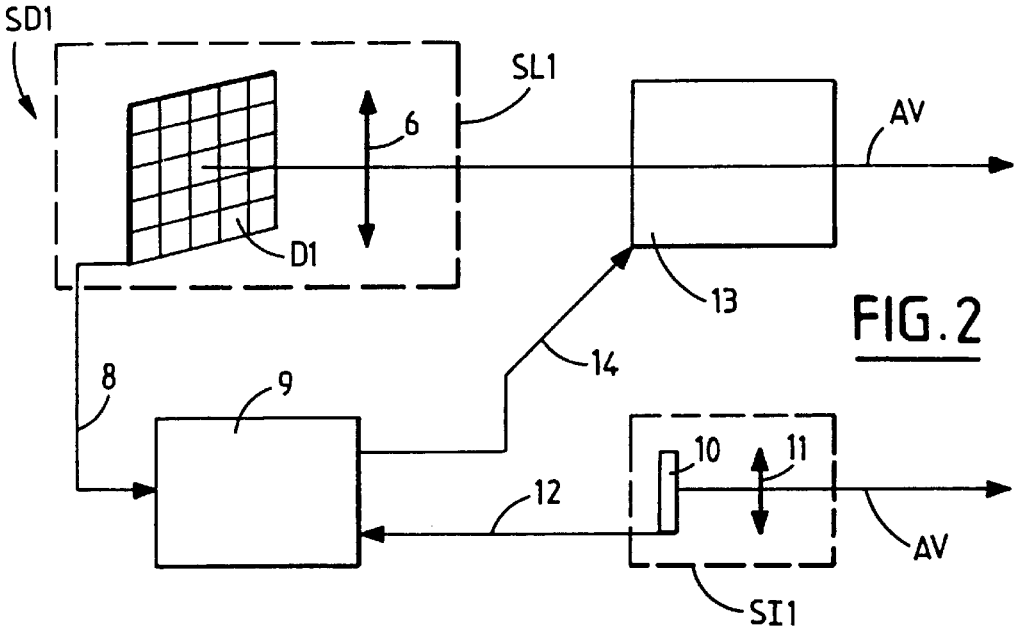
FIG. 2 shows a first embodiment of a detection system of a homing head in accordance with the invention.
Figure 3:
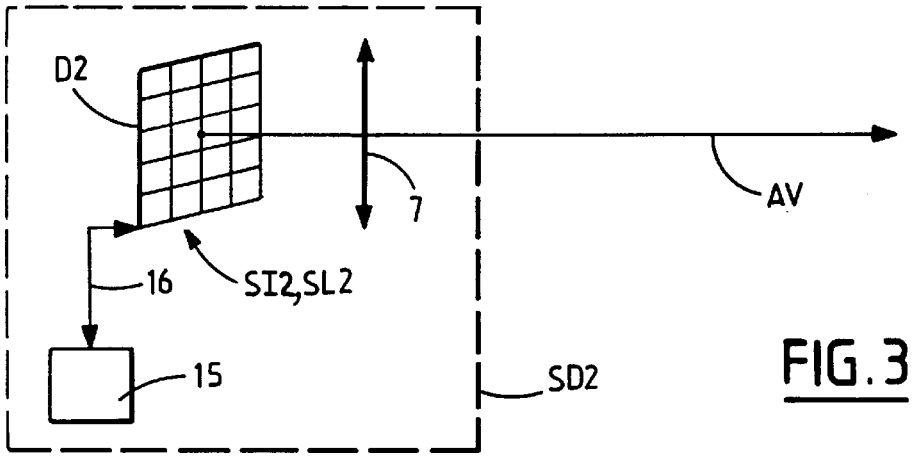
FIG. 3 shows a second embodiment of a detection system of a homing head in accordance with the invention.

The aforesaid elements SI1 SL1, D1 and 6 correspond to the essential elements of a first embodiment SD1 of the detection system, represented in FIG. 2, whereas the elements SI2, SL2, D2 and 7 correspond to those of a second embodiment SD2 represented in FIG. 3.

Thus, since by virtue of the invention the photosensitive detector D1 or D2 is fixed, the homing head A does not require a stabilization platform (which is complex and costly), as is the case for known homing heads.

In the first embodiment SD1 of FIG. 2:

- the photosensitive detector D1 is a matrix detector, of the type with charge coupled device, which is linked by a link 8 to a calculating unit 9 which locates the target C on the basis of the information received from said photosensitive detector D1; and
- the system SI1 for identifying luminous flashes EL includes a photosensitive diode 10, which transforms the luminous energy received into an electrical signal, and a means of focussing 11 which dispatches to said photosensitive diode 10 the luminous flashes EL originating from the scene viewed by the detector D1 and centered relative to the sighting axis AV of the homing head 1.

Said system SI1 transmits the electrical signals generated by the photosensitive diode 10 to the calculating unit 9 via a link 12.

From these signals said calculating unit 9 is capable of identifying said target C, in the manner described below with reference to the second embodiment of FIG. 3.

The detection system SD1 additionally includes a shutter 13 which is mounted fore of the system SL1 on the sighting axis AV in such a way as to shut off the field of view of the photosensitive detector D1.

Preferably, said shutter 13 shuts off, in normal operation, said field of view and frees it only when the calculating unit 9 informs it, by way of a link 14, that a target C has been identified by the system SI1.

More precisely, said field of view is freed when a luminous flash EL originating from the target C is expected so that the photosensitive detector D1 can then detect this luminous flash EL and the system SD1 can deduce the location of the target C therefrom.

In the second embodiment represented in FIG. 3, the detection system S2 is a single system, in which the identification system SI2 and the locating system SL2 together comprise said photosensitive detector D2, such as specified below with reference to FIG. 4.

Figure 4:
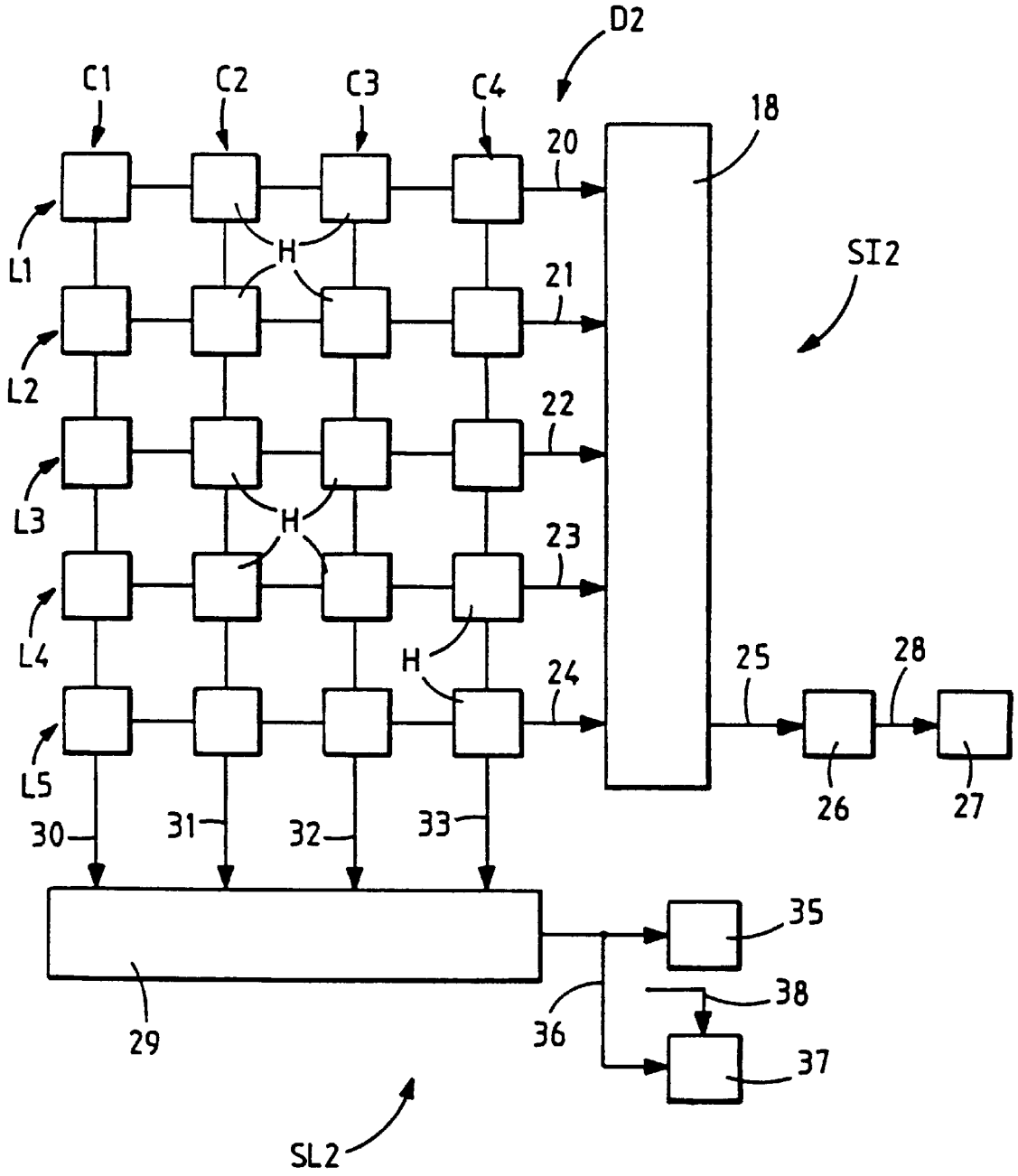
FIG. 4 shows diagrammatically a photosensitive detector of said second embodiment.

Said detection system SD2 includes, in addition to said photosensitive detector D2 and said means of focussing 7, a central unit 15 which is linked by a link 16 to the photosensitive detector D2, which controls the essential elements of said photosensitive detector D2, which are represented in FIG. 4 and specified below, which comprises, as appropriate, certain of these elements and which receives and processes the results generated by them.

As may be seen in FIG. 4, the photosensitive detector D2 includes photosensitive sensors H arranged in matrix form.

Said photosensitive sensors H are linked together in rows L1, L2, L3, L4, L5 and columns C1, C2, C3, C4.

According to the invention, said identification system SI2 detects any variation in illumination of one of said photosensitive sensors H, which is greater than a predefined value and which is characteristic of the illuminating of said photosensitive sensor H by a luminous flash EL.

In the embodiment represented in FIG. 4, said identification system SI2 monitors the binary state specified below of all said photosensitive sensors H likewise specified below, so that any change of state, from the 0 state (or the state of non-illumination by a luminous flash EL) to the 1 state (or state of illumination by a luminous flash EL), is regarded as a characteristic variation in illumination, i.e. is representative of the detection of a luminous flash EL.

To do this, said identification system SI2 includes:

- a network 18 of shift registers respectively linked to the rows L1, L2, L3, L4 and L5 by links 20 to 24, said network 18 making it possible to forward, by a link 25, row by row, the binary state of each of the photosensitive sensors H; and
- a means 26 of evaluating the binary state of the photosensitive sensors H, which is linked to the link 25 and makes it possible to extract the 1 states representative of a detection of luminuous flashes EL.

Figure 4A:
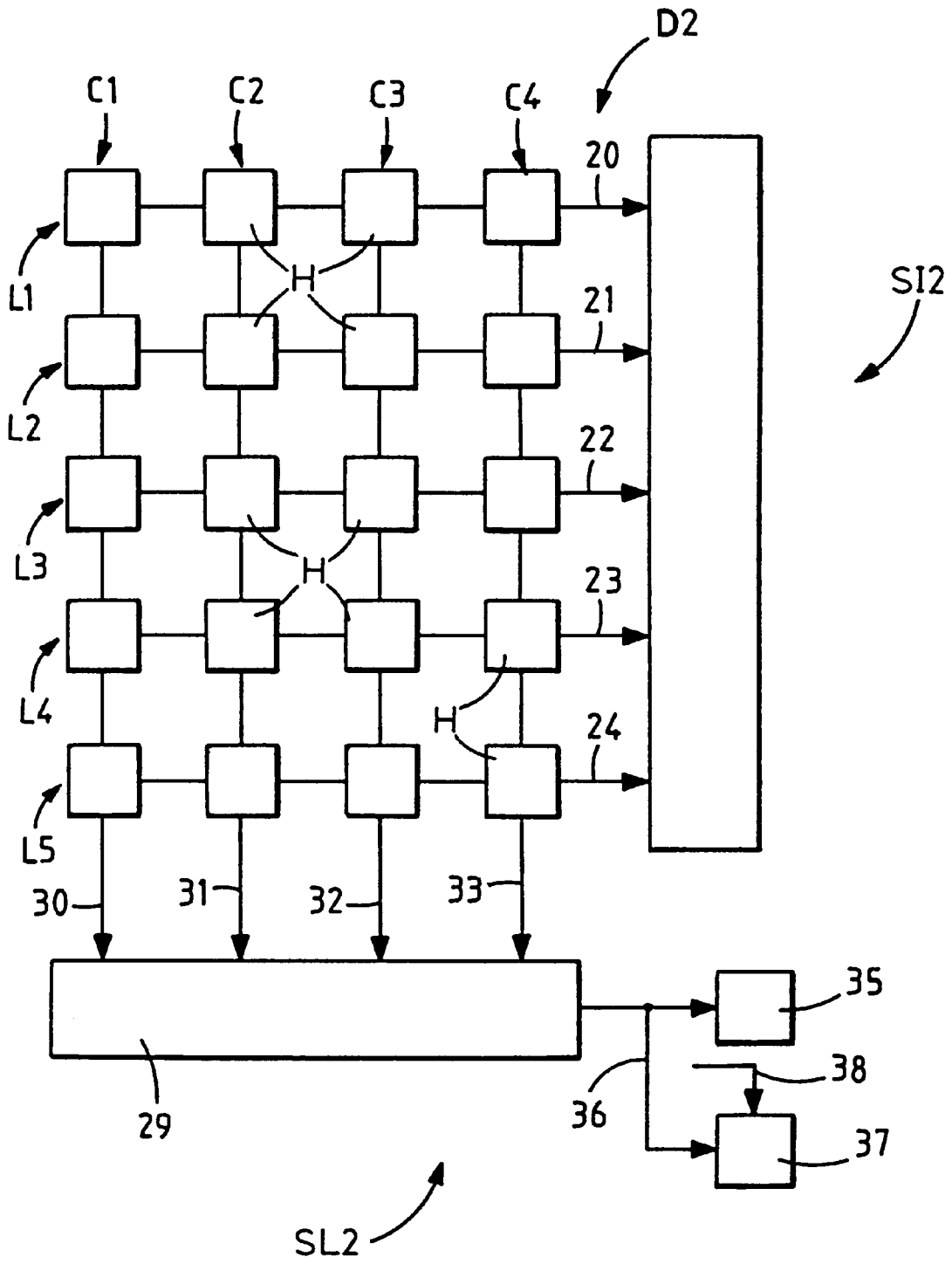
FIG. 4A shows an alternative photosensitive detector.

In another embodiment (see FIG. 4A), the identification system is formed in such a way as to monitor the electrical current consumed by each of said photosensitive sensors H, any increase in said consumed electrical current, which is greater than a predefined increase, then indicating a characteristic variation in illumination.

Furthermore, said identification system SI2 additionally includes a means 27 linked by a link 28 to the means 26, for identifying said target C which reflects luminous flashes EL at constant and predefined time intervals T.

For this purpose, said means 27:

- records any characteristic variation in illumination;
- measures the time interval between two successive detected characteristic variations in illumination;
- compares the time interval thus measured with said predefined time interval T; and
- identifies or does not identify the target C depending on this comparison, as will be seen below with reference to FIG. 5.

Moreover, said locating system SL2 includes, according to the invention, a network 29 of shift registers respectively linked to the columns C1, C2, C3 and C4 of the photosensitive detector D2 by links 30 to 33, said network 29 making it possible to transmit in series, in a predefined order, the binary state of all the photosensitive sensors H, the order of each photosensitive sensor H in the transmission series being representative of its position in said matrix.

Thus, it is possible to locate the position of any photosensitive sensor H exhibiting a 1 state.

Of course, it is possible for a single luminous flash EL of large diameter to place several photosensitive sensors H in their 1 state. Also, in order to be able to carry out accurate locating in such a case, the locating system SL2 additionally includes, according to the invention, a means of calculation 35 linked by a link 36 to the network 29 and determining a central position from the located positions of all the photosensitive sensors H which have detected a luminous flash EL.

Moreover, in a particularly advantageous embodiment, the locating system SL2 additionally includes a means of calculation 37:

- which receives
  - by the divided link 36, the position of all the photosensitive sensors H having detected a luminous flash EL; and
  - by a link 38, the intensity of the signal Vs generated by a means of processing, specified below, of each of said photosensitive sensors H having detected a luminous flash EL; and
- which calculates, from the intensities and positions thus received, the corresponding barycenter which represents the sought-after location.

Figure 5:
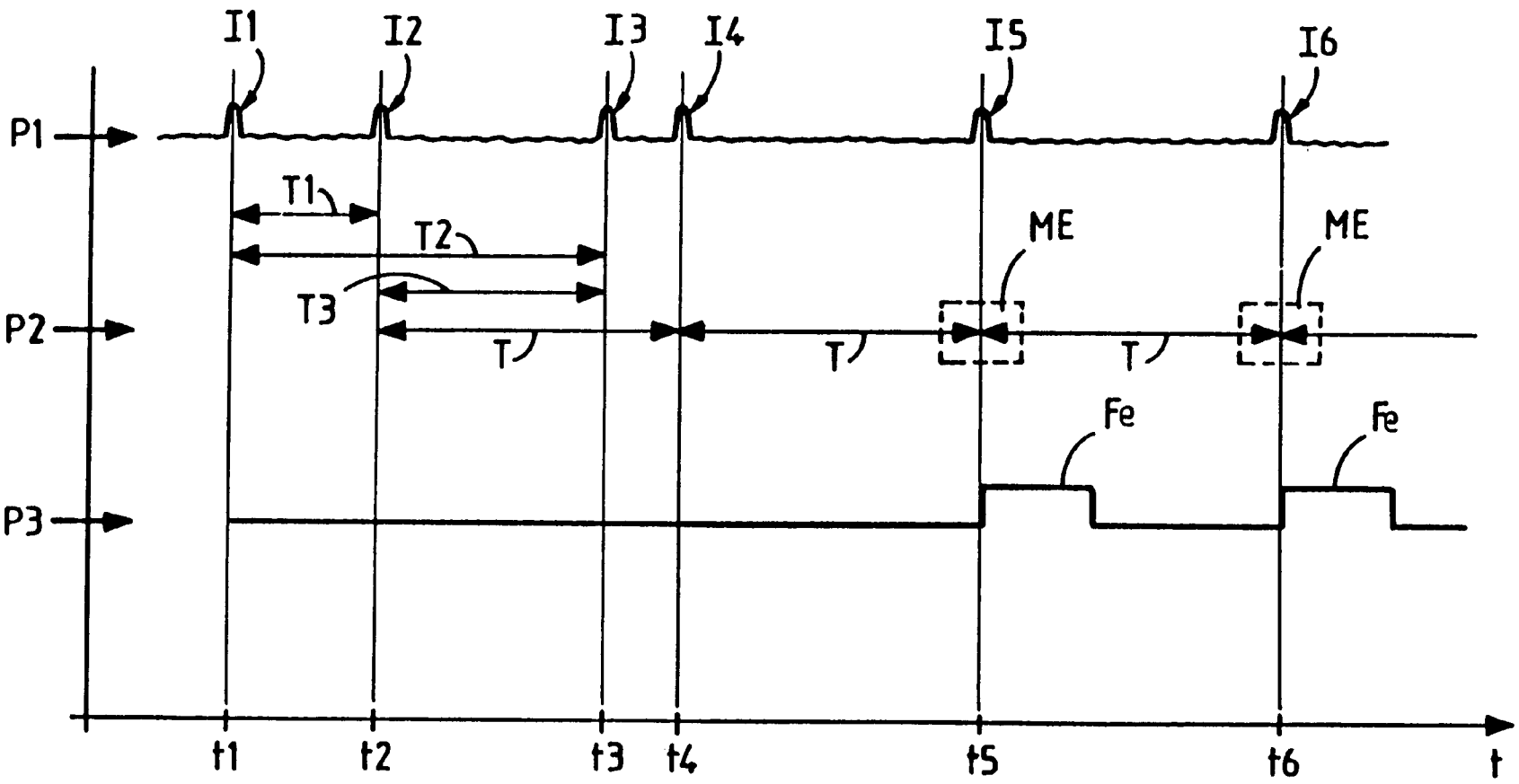
FIG. 5 illustrates, as a function of time, the operations carried out in accordance with the invention, by a detection system of a homing head.

FIG. 5 is a diagram illustrating, as a function of time t, the various steps of such a procedure for identifying and locating a target C by means of the detection system SD2.

Preferably, during detection, the identification system SI2 is on stand-by and the locating system SL2 is idle.

Represented on a line P1 of FIG. 5 are the various illuminations I1 to I6 detected as a function of time t respectively at instants t1 to t6, by the photosensitive detector D2 and corresponding to luminous flashes EL received.

Illustrated on a line P2 is the identifying, by means of the identification system SI2, from among all the detected illuminations I1 to I6, of those which originate from the target C, i.e. those which are separated by a time T. As, on the one hand, the durations T1 between t1 and t2 and T3 between t2 and t3 are less than T, and as, on the other hand, the duration T2 between t1 and t3 is greater than T, the pairs I1/I2, I1/I3 and I2/I3 do not correspond to two successive illuminations reflected by the target C.

Conversely, the duration between the instants t2 and t4 is equal to T, taking account, of course, of the possible error margins. Having thus identified a pair of illuminations I2 and I4 reflected by the target C, it is possible to predict the instants t5, t6, . . . of the next illuminations I5, I6, . . . reflected by said target C, at durations T, 2T, . . . after t4, to within a margin of errors ME.

The locating system SI2 can then be activated during time windows Fe, at said instants t5, t6, . . . , so that the system locates the target C, in the manner described above.

Figure 6:
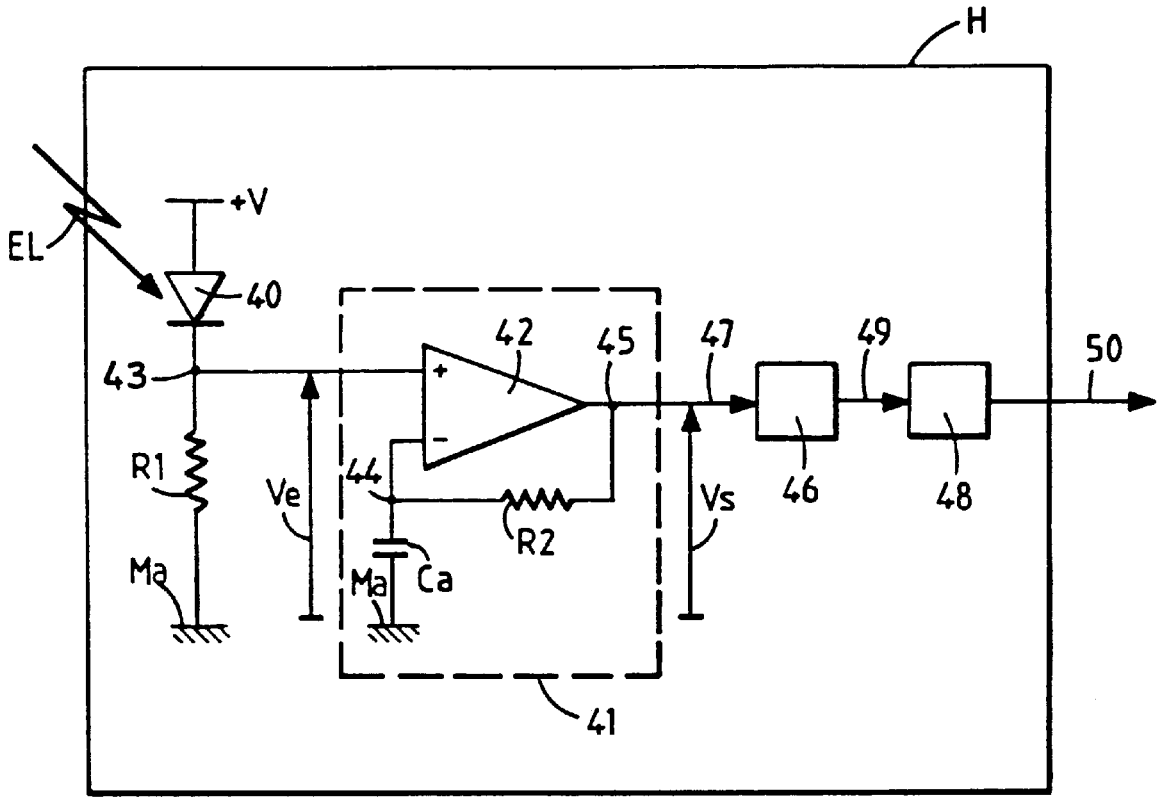
FIG. 6 diagrammatically shows a photosensitive sensor of the photosensitive detector of FIG. 4.

Represented in FIG. 6 is one of the photosensitive sensors H used in the photosensitive detector D2 in accordance with the invention.

According to the invention, said photosensitive sensor H includes:

- a photosensitive diode 40 which is linked, on the one hand, to a positive voltage +V and, on the other hand, to ground Ma via a resistor R1, and which is capable of transforming the luminous energy received into an electrical signal; and
- a means 41 of processing the electrical signals generated by the photosensitive diode 40.

Said means 41 is embodied in the form of a differentiator electrical circuit, of known type, including:

a differential amplifier 42, whose non-inverting input (+) is linked to a connection point 43 situated between the photosensitive diode 40 and the resistor R1 and whose inverting input (−) is linked to ground Ma via a capacitor Ca; and a resistor R2 linked, on the one hand, to a connection point 44 between the capacitor Ca and the inverting input (−) and, on the other hand, to the output 45 of the differential amplifier 42.

Figure 7:
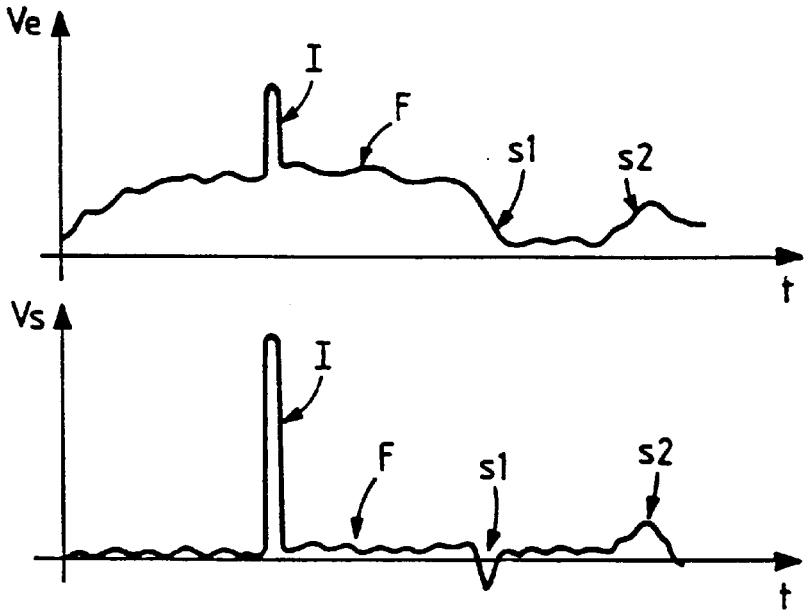
FIG. 7 illustrates the processing of an electrical signal by a means of processing of the photosensitive sensor of FIG. 6.

During the illumination of the photosensitive diode 40, said means of processing 41 transforms the electrical signal generated by said photosensitive diode 40 and represented in the form of a voltage Ve in FIGS. 6 and 7, into a processed signal represented in the form of a voltage Vs. As may be seen in FIG. 7, by comparing the diagrams respectively illustrating the variations in said voltages Ve and Vs, as a function of time t, the processing of the means of processing 41 is such that:

on the one hand, it strengthens the electrical signals I exhibiting a rapid rise time and corresponding to a luminous flash EL detected by the photosensitive diode 40. It also discerns the relatively abrupt variations s1 and s2 in the luminous background noise F; and on the other hand, it attenuates the electrical signals exhibiting a slower time variation and corresponding to illuminations which vary only slightly in intensity, i.e. essentially said luminous background noise F.

Thus, by virtue of the invention, it is possible to discern short pulses within the luminous background noise F, this making it possible to detect, accurately, luminous flashes EL of reduced intensity relative to said luminous background noise F. The photosensitive sensor H thus makes it possible, in particular, to detect low-intensity pulses emitted or reflected by a target C situated a large distance away from said photosensitive sensor H and therefore from said flying body M.

According to the invention, said photosensitive sensor H additionally includes, as represented diagrammatically in FIG. 6:

a means of binarization 46 which is linked by a link 47 to the output 45 of the differential amplifier 42 and which compares said voltage Vs at the output 45 with a reference voltage Vo and allocates, depending on the result, a 0 binary state (if Vs is less than Vo) or 1 binary state (if Vs is greater than Vo) to said photosensitive sensor H; and a means of storage 48 which is linked to the binarization means 46 by a link 49, which records the binary state determined by the latter means and which can transmit this information via a link 50.

We claim:

1. A homing head mounted on a flying body (M), intended to determine orders for guiding said flying body (M) towards a target (C) which emits luminous flashes (EL), said homing head comprising:

a target detection system (SD2);

a source of inertial information (2); and a central unit (3) for processing information determining said guidance orders, wherein said target detection system (SD2) comprises:

a target locating system (SL2) comprising:

a photosensitive detector (D2) mounted fixedly on the flying body (M) having a field capable of covering a predetermined zone of detection of the target (C) and comprising a matrix of photosensitive sensors (H) respectively fitted with photosensitive diodes (40) capable of transforming the luminous energy received into an electrical signal; and a focusing apparatus (6) which projects onto said matrix of the photosensitive detector (D2) the image of the scene situated fore of the flying body (M); and a system (SI2) for identifying luminous flashes (EL) originating from the target (C), which is capable of detecting a characteristic variation in illumination, that is greater than a predefined variation, of at least one of said photosensitive sensors (H) and which monitors an electrical parameter associated with each of said photosensitive sensors, any increase in said electrical parameter, that is greater than a predefined increase, indicating a characteristic variation in illumination.

2. The homing head as claimed in claim 1, wherein said locating system (SL2) is adapted to locate in the matrix of the photosensitive detector (D2) the position of each photosensitive sensor (H) which detects a luminous flash (EL).

3. The homing head as claimed in claim 2, wherein said locating system (SL2) comprises a network (29) of shift registers for transmitting in series a predefined order the binary state of all the photosensitive sensors (H), the order of each photosensitive sensor (H) in the transmission series being representative of its position in the matrix.

4. The homing head as claimed in claim 2, wherein said locating system (SL2) includes a means of calculation (35) for determining a central position from the located positions of all the photosensitive sensors (H) having detected a luminous flash (EL).

5. The homing head as claimed in claim 2, wherein said locating system (SL2) determines the intensity of the signal generated by a means of processing (41) of each of the photosensitive sensors (H) having detected a luminous flash (EL), determines the position of each of said photosensitive sensors (H) having detected a luminous flash (EL), and calculates, from the intensities and positions thus determined, the corresponding barycenter which represents a sought-after location.

* * * * *